US008202040B2

(12) United States Patent
Koenig

(10) Patent No.: US 8,202,040 B2
(45) Date of Patent: Jun. 19, 2012

(54) PUMP HEADER AND IMPLEMENTATION THEREOF

(76) Inventor: Kevin J. Koenig, Manlius, NY (US)

( * ) Notice: Subject to any disclaimer, the term of this patent is extended or adjusted under 35 U.S.C. 154(b) by 96 days.

(21) Appl. No.: 12/828,942

(22) Filed: Jul. 1, 2010

(65) Prior Publication Data

US 2011/0155938 A1 Jun. 30, 2011

Related U.S. Application Data

(63) Continuation-in-part of application No. 11/691,775, filed on Mar. 27, 2007, now Pat. No. 7,775,762, which is a continuation-in-part of application No. 11/277,556, filed on Mar. 27, 2006, now Pat. No. 7,507,066.

(51) Int. Cl.
*F04B 23/04* (2006.01)

(52) U.S. Cl. ..... 415/60; 415/151; 415/203; 415/912

(58) Field of Classification Search ..... 415/60, 415/148, 151, 182.1, 203, 912
See application file for complete search history.

(56) References Cited

U.S. PATENT DOCUMENTS

| | | | | |
|---|---|---|---|---|
| 2,649,049 | A | 8/1953 | Pezzillo | |
| 3,286,639 | A | 11/1966 | Hutton | |
| 3,898,014 | A * | 8/1975 | Meister et al. | 415/56.6 |
| 4,173,234 | A | 11/1979 | Thomas et al. | |
| 4,397,418 | A | 8/1983 | Johansson et al. | |
| 4,643,652 | A | 2/1987 | Eberhardt | |
| 5,119,988 | A | 6/1992 | Fiedrich | |
| 5,154,584 | A | 10/1992 | McEwen | |
| 5,201,633 | A | 4/1993 | Peu | |
| 5,443,207 | A | 8/1995 | Genga | |
| 5,622,221 | A | 4/1997 | Genga, Jr. et al. | |
| 5,664,939 | A | 9/1997 | Giordani et al. | |
| 6,082,976 | A | 7/2000 | Kempf et al. | |
| 6,126,081 | A | 10/2000 | Calvin et al. | |
| 6,220,520 | B1 | 4/2001 | Gibbs | |
| 6,345,770 | B1 | 2/2002 | Simensen | |
| 6,712,027 | B2 | 3/2004 | Rocheleau | |
| 6,799,943 | B2 | 10/2004 | Racer et al. | |
| 2004/0050231 | A1 | 3/2004 | Chu et al. | |
| 2004/0262412 | A1 | 12/2004 | Sweet | |
| 2005/0257843 | A1 | 11/2005 | Simensen et al. | |
| 2006/0016903 | A1 | 1/2006 | Sweet | |

FOREIGN PATENT DOCUMENTS

| | | | |
|---|---|---|---|
| DE | 2052912 | A1 | 5/1972 |
| WO | WO-2007112398 | A2 | 10/2007 |

OTHER PUBLICATIONS

European Patent Office, Supplementary European Search Report for Application No. EP07759478; dated Feb. 16, 2012, 6 pages.

* cited by examiner

*Primary Examiner* — Igor Kershteyn
(74) *Attorney, Agent, or Firm* — Harris Beach PLLC

(57) ABSTRACT

A header body for use in fluid circulation systems such as a hydronic heating system is provided in which the header body is configured to couple fluid flow to individual fluid circuits of the system. In one embodiment, the header body comprises a suction chamber with a fluid passage through which fluid flows as between one or more header bodies coupled together to form a manifold. A valve is disposed in the suction chamber, wherein in one example the valve comprises a valve body that is supported by portions of the suction chamber on opposite sides of the fluid passage. The valve body is configured with an aperture that is aligned with the fluid passage in a first and second operating state, one of which decouples the fluid circuit from the system.

20 Claims, 6 Drawing Sheets

PUMP HEADER AND IMPLEMENTATION THEREOF

CROSS-REFERENCE TO RELATED APPLICATIONS

This application is a continuation-in-part of and claims the benefit of priority from U.S. patent application Ser. No. 11/691,775, entitled "Pump Header Body and Modular Manifold," filed on Mar. 27, 2007, and which claims the benefit of priority from U.S. patent application Ser. No. 11/277,556, entitled "Pump Header Body and Modular Manifold," and filed on Mar. 27, 2006. The content of these applications is incorporated herein by reference in their entirety.

TECHNICAL FIELD

The present disclosure relates to modular manifolds, and more particularly to a header body for use with a pump to distribute fluids to a fluid-circulation circuit that is part of a system of multiple fluid-circulation circuits.

BACKGROUND

Systems that circulate fluid through multiple fluid circuits, such as hydronic heating systems, typically utilize several pumps, one being dedicated to each of the fluid circuits of the system. The pump is connected to a manifold, the construction of which permits fluid from a single fluid source such as a water tank to be flowed to all of the fluid circuits. In many systems, the manifold is modularized such as by deploying a plurality of header bodies, which are coupled together and to the pumps and the fluid circuit. Often the header bodies are positioned adjacent one another so that the manifold can deliver fluid to all of the fluid circuits.

Because footprint of systems such as the hydronic heating systems is often critical, it is beneficial to reduce the space required for the manifold and, accordingly, the header bodies of the manifold. Moreover, these systems often require maintenance and repair. Pump failure and related defects can compel changes wherein it is necessary to disconnect one or more pumps from the manifold. Expansion of the system such as by installing or activating additional fluid circuits is also typically required as would occur in connection with upgrades to the system.

Therefore it would be advantageous to provide a header body and related modular manifold and system that is configured to avoid having to drain fluid from the entire system when one or more pumps is removed or taken off-line from the overall system. It would be likewise advantageous to permit construction of the system to include un-used fluid circuits in initial configurations, wherein such un-used fluid circuits permit expansion of the system as desired.

SUMMARY

There is described below a header body that is configured to attach to adjacent header bodies to form the modularized manifold. Embodiments of the header body are likewise adapted to decouple the corresponding fluid circuit from the manifold, while maintaining the other fluid circuits in fluid communication with the fluid source. Moreover, and to facilitate these features, configurations of the header body are disclosed that are constructed so as to economize the footprint of the manifold and the system overall, without sacrificing fluid flow properties such as flow rate, velocity, and pressure drop across the individual header body and the manifold as a whole.

These and other features are provided in one or more embodiments of the present disclosure, in which:

In one embodiment, a manifold header comprises a header body comprising a pair of opposing openings and an opening for receiving a pump. The manifold header also comprises a suction chamber coupled to the header body, the suction chamber comprising a fluid passage in communication with each of the pair of opposing openings. The manifold header further comprises a valve disposed in the fluid passage, the valve comprising a valve body having an aperture therethrough. In one example, the manifold header is defined wherein the valve body is operable in one or more operating states including a first state that couples the suction chamber and the opening of the header body and a second state that decouples the suction chamber and the opening of the header body, and wherein the aperture is aligned with the fluid passage in both the first state and the second state.

In another embodiment, a header body comprises a housing comprising a volute for receiving an impeller of a pump. The header body also comprises a suction chamber fluidly coupled to the volute, the suction chamber comprising a first opening, a second opening, and a fluid passage permitting a fluid to flow between the first opening and the second opening. The header body further comprises a valve disposed in the fluid passage. In one example, the header body is defined wherein the valve comprises a valve body that is supported along one or more peripheral walls of the fluid passage, and wherein the valve body rotates among one or more operating states that comprise a first state that permits the fluid to flow from the fluid passage to the volute and a second state that prohibits the fluid to flow to from the fluid passage to the volute.

In yet another embodiment, a circulation system for a fluid comprises a first header body and a second header body coupled adjacent the first header body. In one example, the circulation system is defined wherein one or more of the first header body and the second header body comprise a volute, a suction chamber in communication with the volute, and a valve disposed in the suction chamber and with a first state that permits the fluid to flow between the suction chamber and the volute. In another example, the circulation system is also defined wherein the valve comprises a valve body secured to peripheral walls of the suction chamber.

BRIEF DESCRIPTION OF THE DRAWINGS

So that the manner in which the above recited features of the present disclosure can be understood in detail, a more particular description of the disclosure briefly summarized above, may be had by reference to the figures, some of which are illustrated and described in the accompanying appendix. It is to be noted, however, that the appended documents illustrate only typical embodiments of this disclosure and are therefore not to be considered limiting of its scope, for the disclosure may admit to other equally effective embodiments. Moreover, any drawings are not necessarily to scale, emphasis generally being placed upon illustrating the principles of certain embodiments of disclosure.

Thus, for further understanding of the nature and objects of the disclosure, references can be made to the following detailed description, read in connection with the drawings in which.

DETAILED DESCRIPTION

Illustrated in the appended drawings and broadly stated, a header body is provided below that is suitable for use in fluid circulation systems such as a hydronic heating system. Exemplary systems typically include several fluid circuits through which fluid is circulated via pumps, which are coupled to the header body. Pertinent to the discussion that follows, the header bodies of the present disclosure can form a manifold, wherein the header bodies are coupled to adjacent header bodies of the same or similar configuration. This manifold simplifies construction of the hydronic heating system, and in one construction fluid such as water flows from a single source into each of the fluid circuits via the header bodies that form the manifold.

Header bodies of the type disclosed herein are further configured to permit one or more of the pumps to be removed from the manifold without disrupting operation of the remaining fluid circuits of the hydronic system. Moreover, as a further improvement over conventional manifolds used in, e.g., hydronic heating systems, the header bodies incorporate a valve that is constructed to reduce the overall dimensions of the header body (and, accordingly the manifold), as well as to maintain flow rate and to reduce the velocity and pressure drop of the fluid as the fluid flows across the header body. These features maintain and/or enhance the efficiency of the pump, thus improving the operation of the fluid circuits coupled to the manifold and the overall hydronic system.

Figure 1:
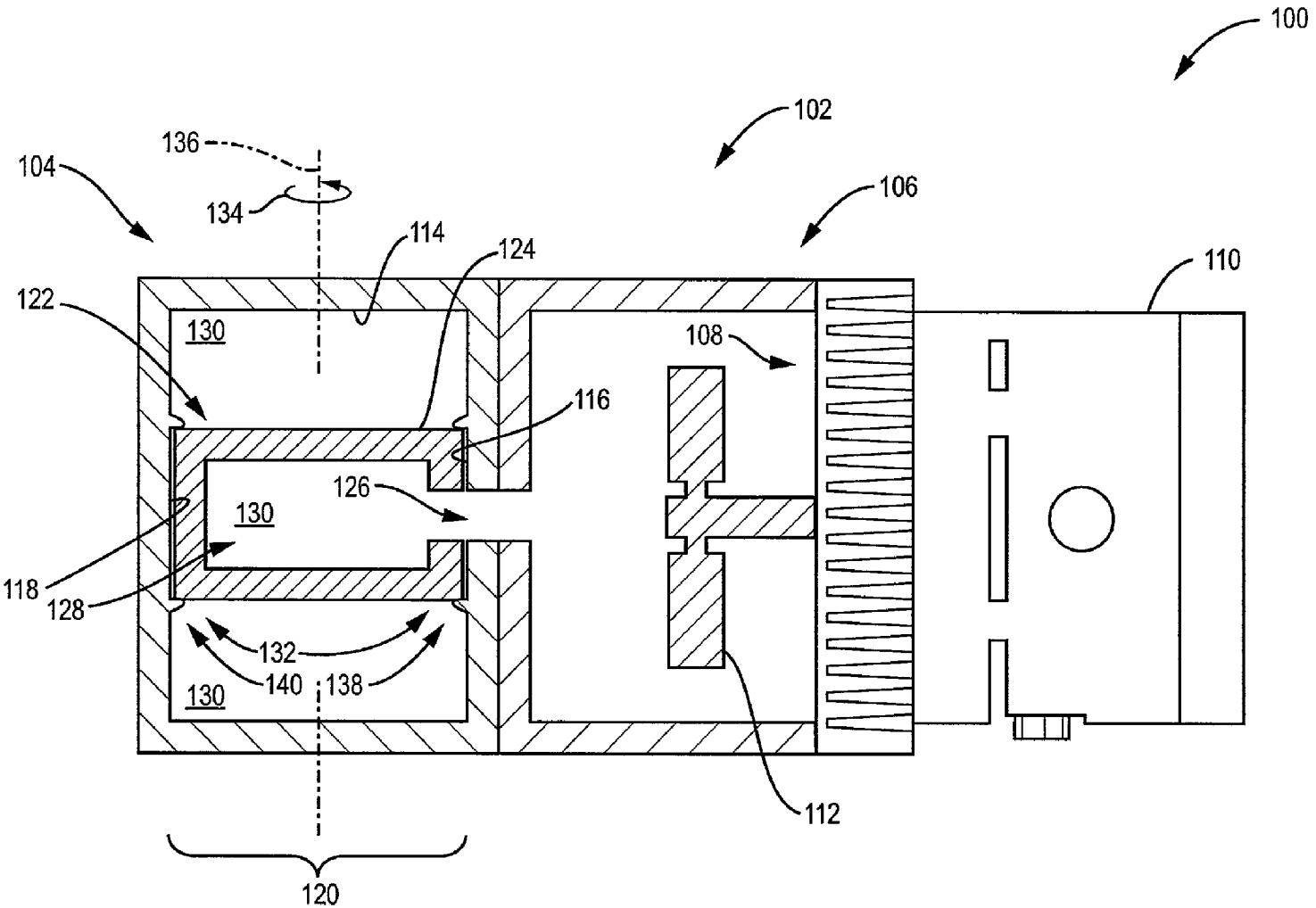
FIG. 1 is a schematic diagram of a cross-section view of an exemplary embodiment of a header body.

Discussion of these features is provided below in connection with the schematic cross-sectional diagram of an exemplary embodiment of a header body 100 that is illustrated in FIG. 1. In this example, the header body 100 comprises a housing 102 and a suction chamber 104, through which fluid such as water can flow. The housing 102 comprises a volute 106 with an opening 108 configured to receive a pump 110, and in one configuration the opening 108 can receive an impeller 112 of the pump 110 therein. The suction chamber 104 is coupled to the volute 106 to permit the fluid to flow between the suction chamber 104 and the volute 106. The suction chamber 104 includes a chamber wall 114 with an inner peripheral wall 116 and an outer peripheral wall 118. The chamber wall 114 forms a fluid passage 120, which is configured to permit the fluid to flow to adjacent ones of the header body 100 that are coupled together to form, e.g., the manifold discussed above.

A valve 122 is disposed in the fluid passage 120. The valve 122 is used to couple and decouple the volute 106 and the fluid passage 120, thus permitting and/or preventing fluid from the suction chamber 104 from entering the volute 106. The valve 122 comprises a valve body 124 that is configured to permit the fluid to flow through the valve 122 in at least three directions. In the present example, the valve body 124 has a pump opening 126 and an aperture 128 that is fluidly coupled to the pump opening 126. The aperture 128 extends through the valve body 124. The valve body 124 is positioned in the fluid passage 120 to form a flow area 130, which in the present example is the effective area of the fluid passage 120 through which flows the fluid in the suction chamber 104.

The valve body 124 includes one or more supported portions 132, which are peripherally supported in the suction chamber 104 such as at or near portions of the chamber wall 114 that are peripheral to the fluid passage 120. This configuration facilitates operation of the valve 122, e.g., to couple and decouple the volute 106 and the fluid passage 120 such as by rotation 134 about an axis 136. In one embodiment, the supported portions 132 include an inner supported portion 138 and an outer supported portion 140. The supported portions 132 are engaged at or near the chamber wall 114, with one configuration utilizing, respectively, one or more peripheral walls such as the inner peripheral wall 116 and the outer peripheral wall 118. This engagement positions the valve body 124 in the fluid passage 120 and aligns the pump opening 126 so as to be fluidly coupled with the volute 106. Exemplary mountings and configurations for such engagement can include bearings and bushings such as those that would fit the valve body 124, as well as features that are incorporated unitarily with the construction of the suction chamber 104, the chamber wall 114, and/or the valve body 124.

Construction of the valve 122 can vary, with configurations of the valve body 124 being selected in one example so that at least a portion of the valve body 124 is encapsulated in the fluid passage 120. In one embodiment, the valve body 124 is positioned inside of the fluid passage 120. Other constructions are likewise contemplated that are useful to reduce the overall dimensions of the header body 100 such as by minimizing the size and shape the suction chamber 104. Suitable devices for use as the valve body 124 can include curvilinear devices (e.g., spheres, ellipses, and egg-shaped), wherein the device has an outer surface that is shaped to facilitate the flow of the fluid. Mechanical and electro-mechanical devices are also suitable such as, but not limited to, check valves, butterfly valves, choke valves, solenoid valves, and variations, derivations, and combinations thereof.

Actuation of the valve body 124 facilitates operation of the valve 122 as between one or more operating states. These operating states can include an open state, in which the volute 106 and the fluid passage 120 are fluidly coupled, such as through the pump opening 126 of the valve body 124. The states can also include a closed state that prevents fluid from flowing between the volute 106 and the fluid passage 120. In one embodiment, the aperture 128 is aligned with the fluid passage 120 in each of the operating states, thus maintaining the size of flow area 130 in both the open state and the closed state. When implemented as part of manifold, such as the manifold discussed above, the maintenance of the flow area 130 is beneficial because the flow properties of the fluid do not change even when one or more of the volute 106 in the manifold are closed to flow of the fluid. In one example, the configuration of the header body 100 is desirable because it minimizes pressure drop across the suction chamber 104.

The housing 102 and the suction chamber 104 can be formed monolithically such as by casting, machining, or using other manufacturing techniques that are suited to form the various features of the header body 100. Examples of this construction are provided in connection with FIGS. 2-5 below. Likewise in other embodiments, the header body 100 can be formed as one or more separate pieces, which are assembled together using fastening mechanisms (e.g., welds and mechanical fasteners such as bolts and screws) of the type that can be used for the fluids and systems used in, e.g., hydronic heating systems.

Figure 2:
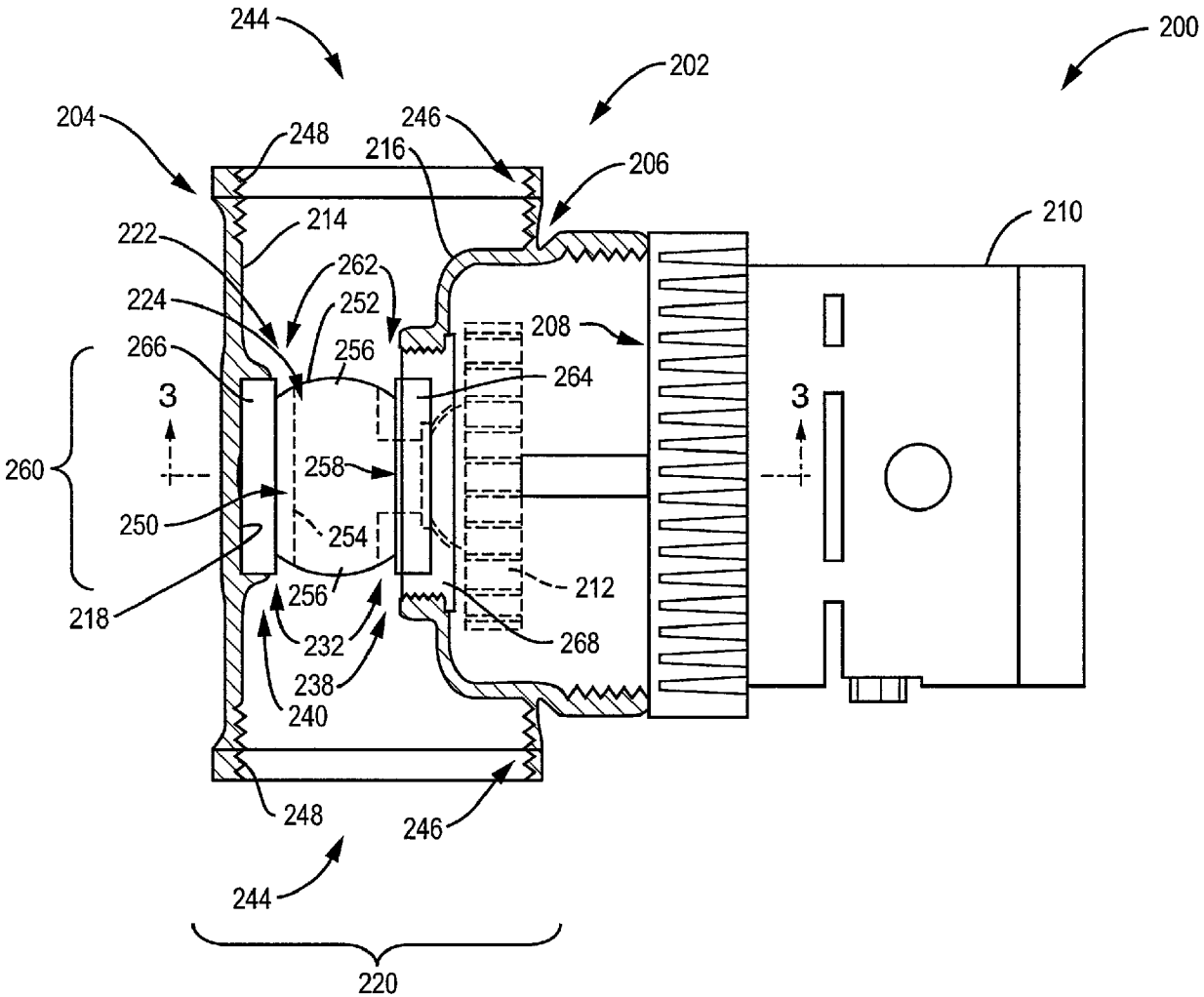
FIG. 2 is a top, partial-cross section view of another exemplary embodiment of a header body.
Figure 3:
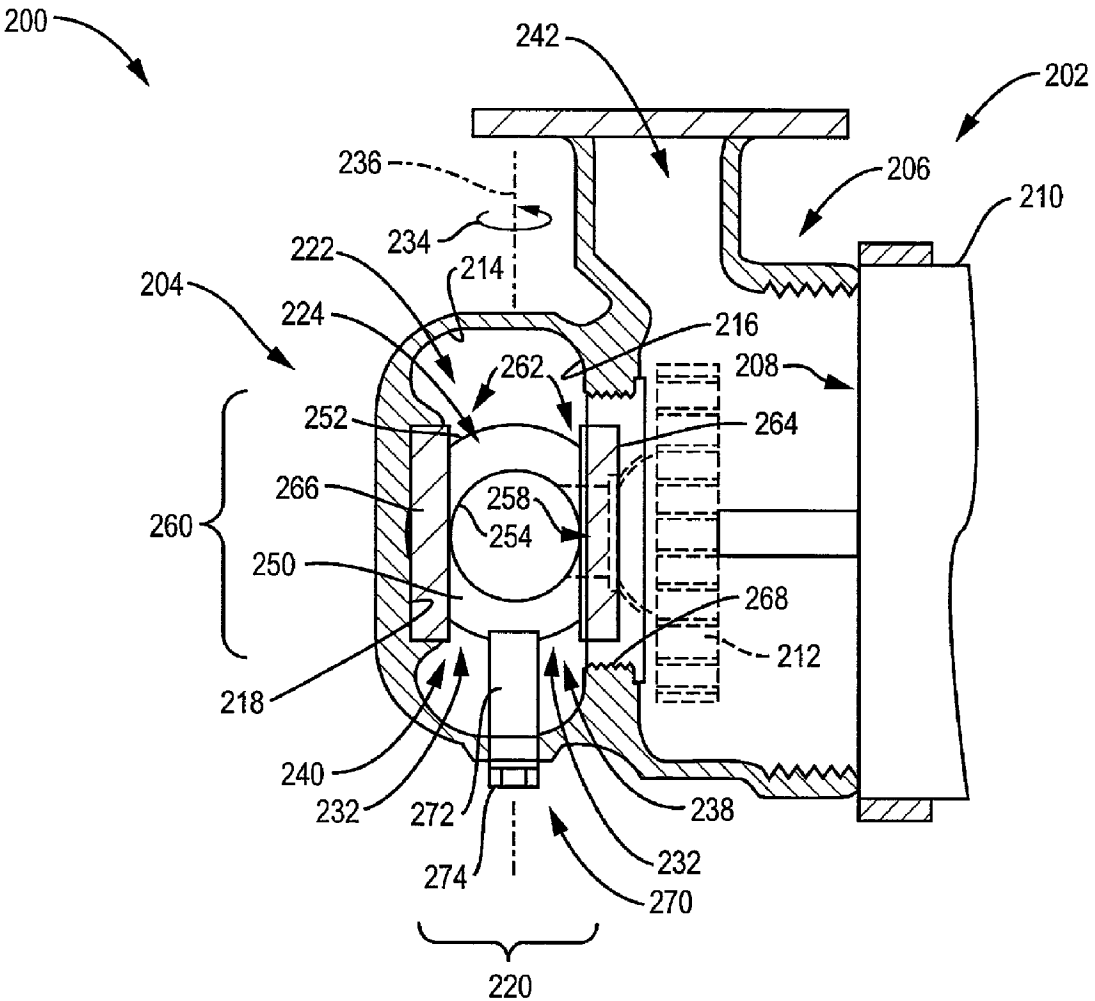
FIG. 3 is a side, cross-section view of the header body of FIG. 2.

Some of these features, broadly described in connection with FIG. 1, are further illustrated in FIGS. 2 and 3 and described in detail below. In FIGS. 2 and 3, there is illustrated another exemplary embodiment of a header body 200 that is configured for use in the systems contemplated herein. Like numerals are used to identify like components as between the header body 100 and the header body 200, but the numerals are increased by 100 (e.g., 100 is now 200 in FIGS. 2 and 3). For example, the header body 200 includes a housing 202, a suction chamber 204, a volute 206, and a pump 210 with an impeller 212. The suction chamber 204 includes a chamber wall 214, including an inner peripheral wall 216 and an outer peripheral wall 218, and forming a fluid passage 220. The header body 200 also includes a valve 222 with a valve body 224, which is configured for rotation 234 about an axis 236. The header body 200 further includes a discharge 242, which is fluidly coupled to the volute 206 to permit fluid to flow under pressure from the impeller 212 of the pump 210. Open ends 244 are located on opposite sides of the fluid passage 220. The open ends 244 can comprise a fastening implement 246 such as a threaded surface 248 disposed thereto. In other examples, the fastening implement 246 can likewise incorporate additional components such as threaded nuts, clamps, as well as threaded surfaces that are located on or proximate the outside surfaces of the open ends 244.

The valve body 224 comprises a ball 250 with a spherical shape 252 having a cylindrical bore 254 that extends through the ball 250 and terminates at bore ends 256. A pump bore 258 is likewise incorporated into the spherical shape 252, with one particular construction having the pump bore 258 located in generally perpendicular relation to the cylindrical bore 254. As depicted in FIGS. 2 and 3, the header body 200 also includes a number of valve components 260 that are implemented to support the ball 250 in the fluid passage 220. The valve components 260 include a pair of ball valve seats 262, including an inner ball valve seat 264 and an outer ball valve seat 266. The valve components 260 also include a ball compression plate 268, which works in combination with the ball valve seats 262 to secure and/or position the ball 250 in the fluid passage 220. The valve 222 also includes an actuator 270 for actuating the valve 222 amongst one or more of the operating states. In the present example, the actuator 270 includes a ball valve stem 272 on which is disposed a handle 274 for manipulating the valve body 224, and more particular to the present example the handle 274 is coupled to the ball 250 to impart the rotation 234 about the axis 236.

The ball valve seats 262 can be concave or otherwise constructed so that the spherical shape 252 is seated in, e.g., the inner ball valve seat 264 and the outer ball valve seat 266. This seating supports the ball 250 within the fluid passage 220, but also permits the rotation 234 of the ball 250 such as by actuation of the handle 274. In one embodiment, one or more of the inner ball valve seat 264 and the outer ball valve seat 266 is secured to the chamber wall 214 such as by fastener (e.g., screws, adhesive, and weld). Portions of the chamber wall 214 such as the inner peripheral wall 216 and the outer peripheral wall 218 can also be constructed with features that engage the ball valve seats 262 such as by press and/or friction fit. This configuration can include bosses, bores, lips, and related material configurations that are arranged to engage and to retain the ball valve seats 262. These features can be incorporated in the suction chamber 204 such as during the manufacturing (e.g., casting) of the suction chamber 204 and/or the housing 202. Combinations of fasteners and features in the chamber wall 214 are likewise contemplated as suitable alternatives for securing the ball valve seats 262 in a position to receive at least a portion of the ball 250 therein.

Securing and positioning the ball 250 in this manner is advantageous because it permits the ball 250 to be secured without negatively affecting the flow of fluid through the fluid passage 220. Peripheral support of the ball 250 exposes portions of the ball 250 to the fluid such as, for example, the cylindrical bore 254 and bore ends 256. This configuration permits fluid to flow through the ball 250 in one or more of the operating state such as the open state and the closed state discussed above. This configuration likewise minimizes obstruction of the fluid as the fluid flows in the fluid passage 220, and in one particular implementation the fluid continues to flow through the ball 250 when the pump 210 is absent from the header body 200. In other examples, the suction chamber 204 is constructed in conjunction with these devices, wherein the design of the resulting header body 200 is configured to minimize pressure drop of the fluid through the suction chamber 204 and to minimize the size of the header body 200.

Figure 4:
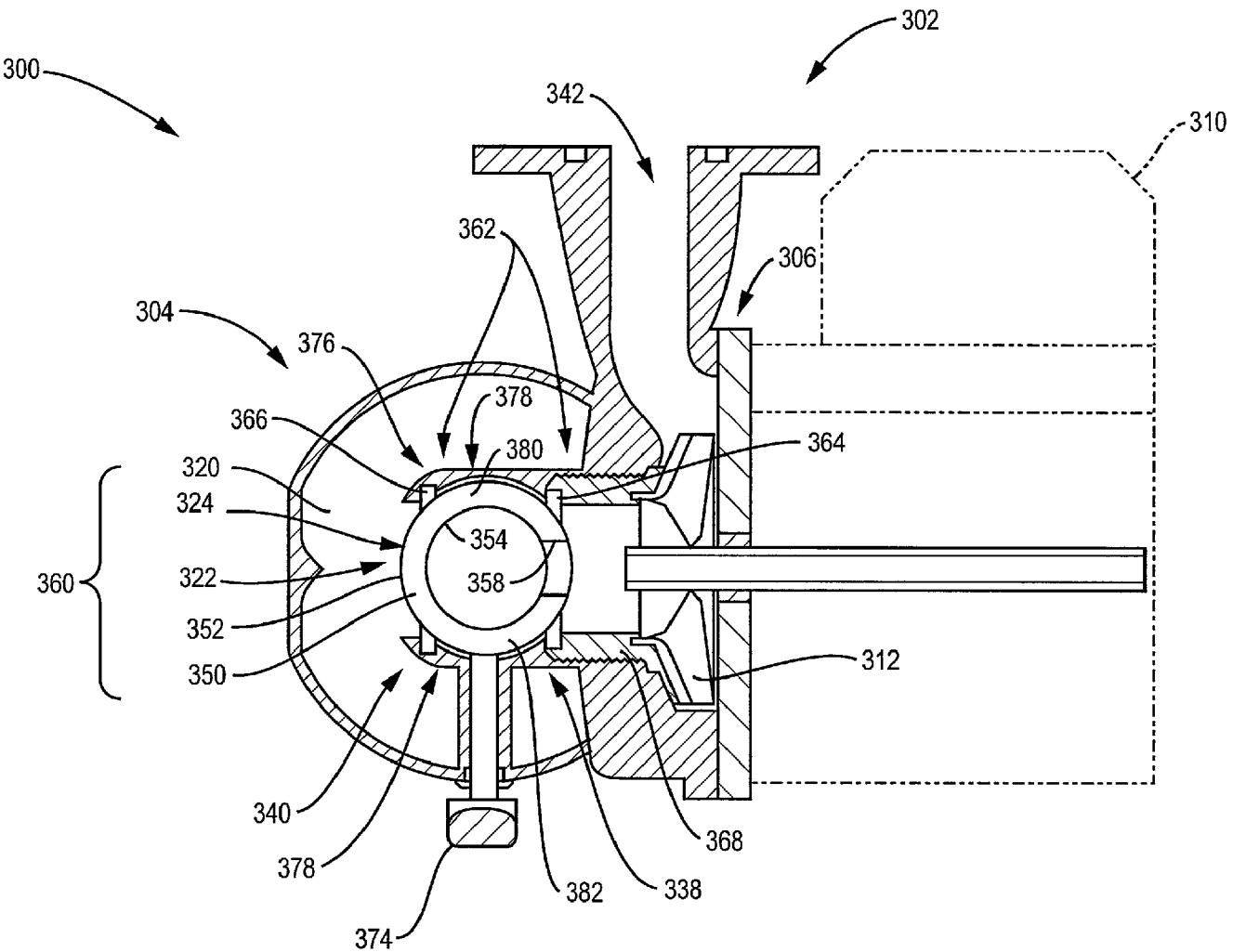
FIG. 4 is a side, cross-section view of yet another exemplary embodiment of a header body.

Referring now to FIG. 4, yet another exemplary embodiment of a header body 300 is illustrated. Again like numerals are used to identify like components as between FIGS. 1-4, wherein in the present example the header body 300 includes a housing 302, a suction chamber 304, a volute 306, a pump 310 with an impeller 312, and a fluid passage 320. The header body 300 also includes a valve 322 with a valve body 324 and a discharge 342. The valve 322 includes a ball 350 with a spherical shape 352. The ball 350, like the ball 250 that is depicted in FIGS. 2 and 3, is configured to permit flow in three directions such as by having a cylindrical bore 354 and a pump bore 358 provided therein.

The header body 300 also includes a valve securing feature 376 with one or more valve receiving areas 378. Each of the valve receiving areas 378 extend into the suction chamber 304 and are configured to receive and engage portions of the valve 322. These portions include portions of the ball 350 as well as one or more valve components 360. In the present example, the valve components 360 include an inner ball valve seat 364, an outer ball valve seat 366, and a ball compression plate 368. The configuration of the valve components 360 and the valve receiving areas 378 are useful to permit rotation of the ball 350 such as by actuation of a handle 374.

The valve securing feature 376 such as the valve receiving areas 378 can be formed integrally with portions of the housing 302 such as by way of machining and/or casting. In one embodiment, the valve securing feature 376 can be assembled as one or more separate pieces fastened to the housing 302 and/or the suction chamber 304. Notably the valve receiving areas 378 are configured to permit fluid to flow into the cylindrical bore 354 from either side, thus effectuating both the three direction flow in the ball 350 and the overall operation of the header body 300 in the open and closed states as discussed herein. Depicted in its open state in FIG. 4, it is contemplated that rotation of the ball 350 about 180° from this initial position will implement the closed state, in which fluid will continue to flow through the ball 350 (e.g., through the cylindrical bore 354), but will not flow to the volute 306.

Various configurations of the valve receiving areas 378 and the valve components 360 can be used to engage and support the periphery of the ball 350. Preferably these configurations position the ball 350 within the fluid passage 320, but do not interfere with operation of the ball 350 as between the open state and the closed state. In the present example, the engagement of the ball 350 occurs on the outer supported portions of the ball 350, and more particularly the inner ball valve seat 364 and the outer ball valve seat 366 are utilized to engage and support, respectively, the inner supported portion 338 and the outer supported portion 340 of the ball 350. Other configurations are likewise contemplated to support and position the ball 350 in the suction chamber 304. While some of these other configurations may utilize valve components (e.g., ball valve seats 362), it is likewise suitable that the features of the ball valve seats 362 are integrated into the valve receiving areas 378. In still other configurations, upper and lower portions of the ball 350, such as an upper supported portion 380 and a lower supported portion 382, are engaged to position the ball 350 in the suction chamber 304.

Pertinent also to the header body 100 and 200 above, the construction of the header body 300 effectuates a minimized dimensional configuration, wherein in one example the suction chamber 304 is located more proximately to the pump 310. Centrally locating the valve 322 in the suction chamber 304 is also beneficial because the valve 322 is relatively unnoticeable from the outside of the suction chamber 304. This minimized dimension configuration allows the header body 300 to be installed in locations where limited space may be an issue.

Figure 5:
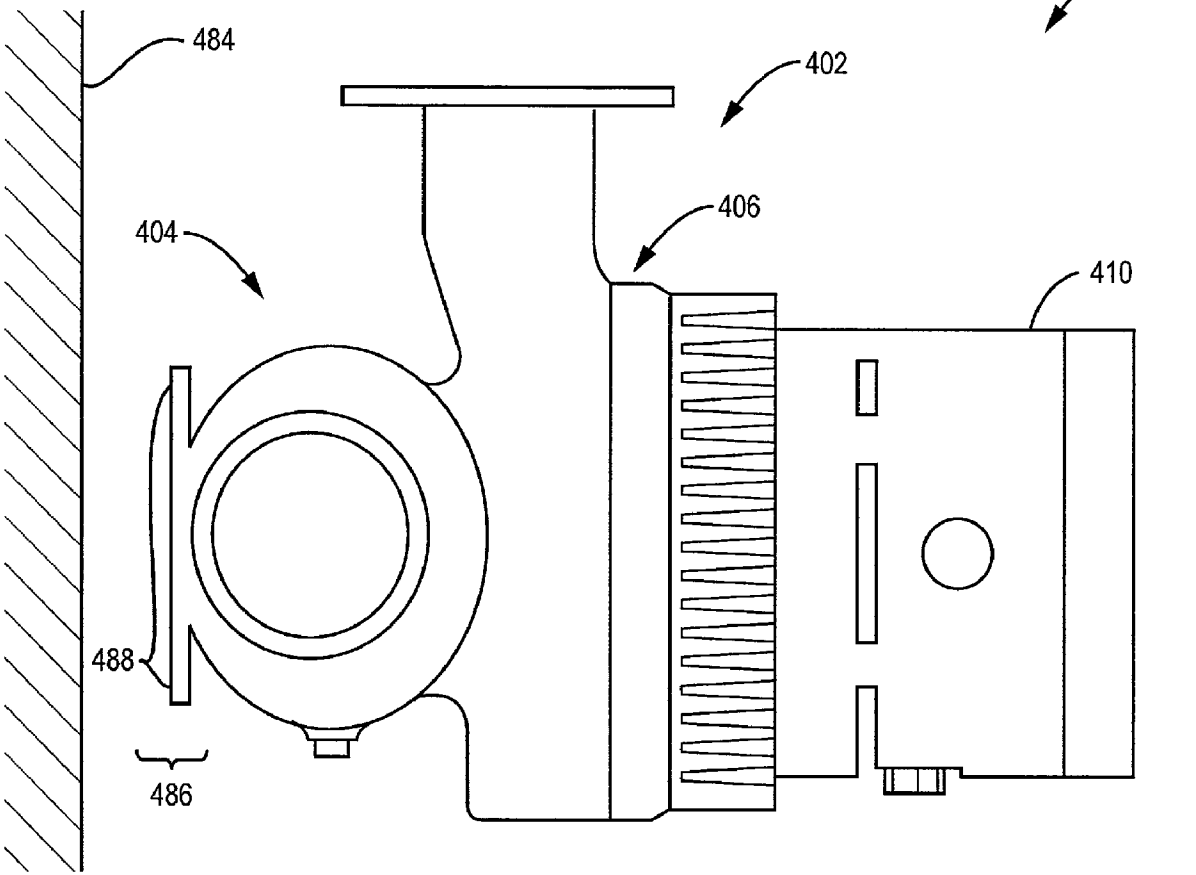
FIG. 5 is a side view of still another exemplary embodiment of a header body.

Referring now to FIG. 5, there is shown still another exemplary embodiment of a header body 400, in which like numerals are used to identify like components as between FIGS. 1-5. By way of example, the header body 400 includes a housing 402, a suction chamber 404, a volute 406, and a pump 410 that is coupled to the volute 406. Although not shown in FIG. 5, one or more of the concepts discussed above in connection with the header body 100, 200, and 300, such as the concepts related to the valves (e.g., the valve 122, 222, and 322), are applicable to the header body 400.

Pertinent to the example depicted in FIG. 5, however, attention is focused on the exterior of the suction chamber 404, which is configured to be mounted to a structure 484 such as a wall, utility panel, or other structure contemplated for use with the systems and manifolds of the present disclosure. In one embodiment, the housing 402 includes a mounting device 486 with one or more mounting feet 488, each configured to work in conjunction with a fastener (not shown) to secure the header body 400 to the structure 484. The mounting device 486 generally, and the mounting feet 488 in particular, can be constructed unitarily with the suction chamber 404. In other constructions the mounting feet 488 are secured to the suction chamber 404 such as by screws, bolts, welds, and/or other fastening mechanism that are suitable for the loading and related physical construction and operation of the header body 400. In other configurations, the mounting device 486 is mounted to the structure 484, and is further constructed to engage the suction chamber 404 and/or the header body 400, thus supporting and securing the header body 400 to the structure 484.

Figure 6:
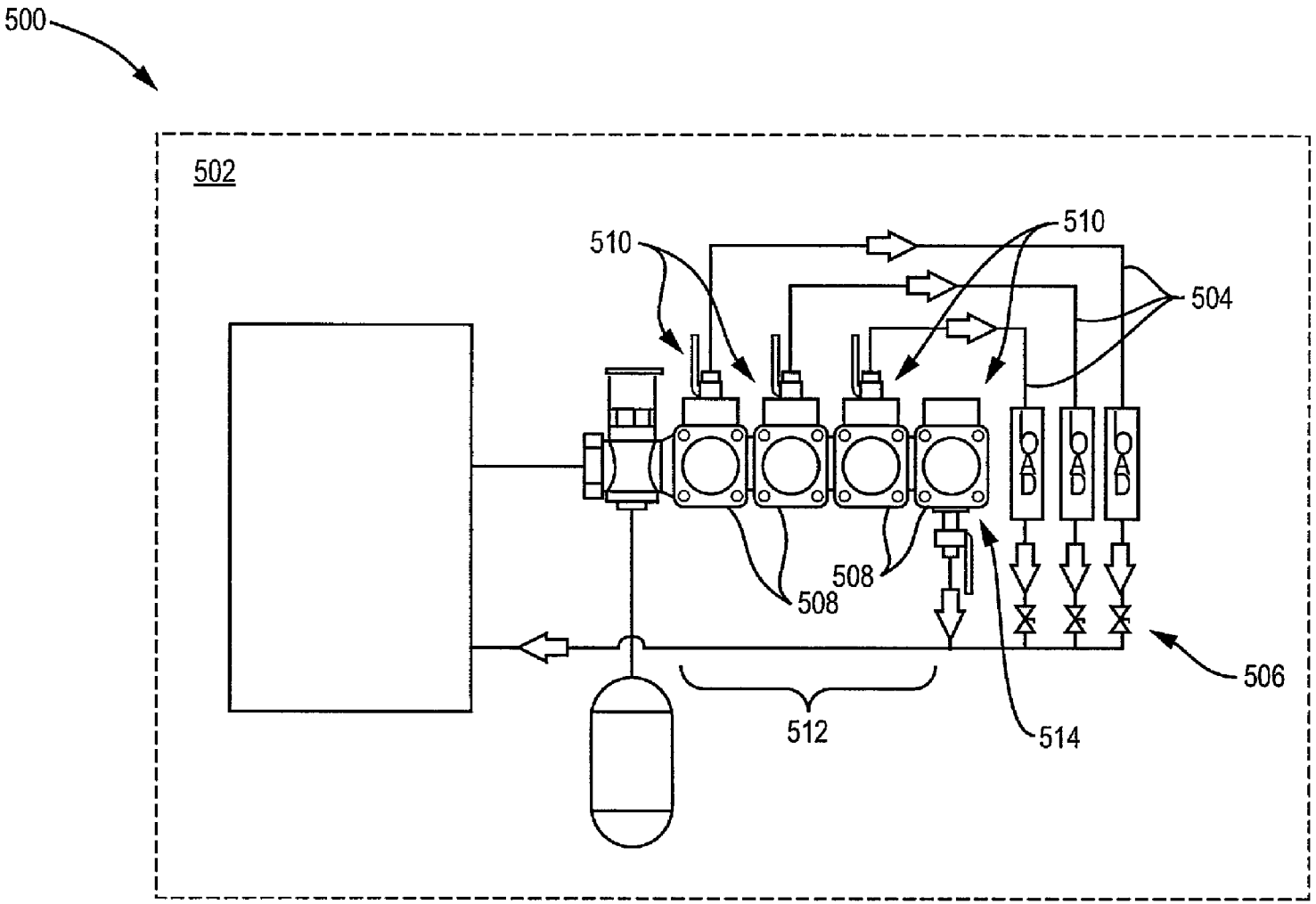
FIG. 6 is a diagram of a fluid circulation system that comprises a plurality of header bodies such as the header bodies of FIGS. 1-5.

For one implementation of embodiments of the header body 100, 200, 300, and 400 of the present disclosure, reference is now directed to an exemplary embodiment of a fluid circulation system 500 in FIG. 6. There is shown that the fluid circulation system 500 includes a hydronic heating system 502 having a plurality of fluid circuits 504 with shut-off valves 506. Fluid is forced through each of the fluid circuits 504 by a pump 508. Each pump 508 is connected to a header body 510 (e.g., the header body 100, 200, 300, and 400). The header body 510 can be connected to form a manifold header 512, and more particularly to the present example each header body 510 is configured to be adjoined to the header body 510 that is immediately adjacent. While a variety of means of connection are contemplated, in one example a quick-clamp fitting can be used such as is provided by Andron Stainless Corporation of Columbia, S.C. (e.g., part no. AC13HP). The manifold header 512 can be closed with a cap (not shown), which is secured to the header body 510 that is last or peripheral in the manifold header 512.

In view of the foregoing, and discussing briefly the operation of the header bodies as implemented in the fluid circulation system 500, by connecting a plurality of header bodies 510 as the manifold header 512 to form a common suction chamber (not shown), it is possible to isolate individual ones of the fluid circuits 504 without affecting the operation of the fluid circuits 504 other than the one selected for isolation. In one example, changing the valve of one of the header bodies 510 from its open state to its closed state, in combination with closing the corresponding shut-off valves 506, isolates one of the fluid circuits 504 from the rest of the fluid circulation system 500. This combination also stops the flow of fluid to the pump 508 in the fluid circuits 504 that are isolated and coupled to the closed valves. Ceasing the flow permits, for example, service and maintenance to be performed on a portion of the fluid circulation system 500 without negatively affecting the flow of fluid through the common suction chamber, which supplies fluid to the fluid circuits 504 via, e.g., the header bodies 510 with valves that are positioned in the open state.

Moreover, because the relationship along the suction chamber is not directional, it is possible to connect one or more of the header bodies 510 in a position that is inverted such as inverted with respect to the header bodies 510 coupled adjacent to the header bodies 510, which is in a selectively inverted configuration. In one embodiment, as shown in FIG. 5, one of the header bodies 510, in this case an inverted header body 514 may be positioned to discharge fluid in a direction that is different from the header bodies 510 of the manifold header 512.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

While the present disclosure has been particularly shown and described with reference to certain exemplary embodiments, it will be understood by one skilled in the art that various changes in detail may be effected therein without departing from the spirit and scope of the disclosure as defined by claims that can be supported by the written description and drawings. Further, where exemplary embodiments are described with reference to a certain number of elements it will be understood that the exemplary embodiments can be practiced utilizing either less than or more than the certain number of elements.

What is claimed is:

1. A manifold header comprising:

a header body comprising a pair of opposing openings and an opening for receiving a pump;

a suction chamber coupled to the header body, the suction chamber comprising a fluid passage in communication with each of the pair of opposing openings; and a valve disposed in the fluid passage, the valve comprising a valve body having an aperture therethrough, wherein the valve body is operable in one or more operating states including a first state that couples the suction chamber and the opening of the header body and a second state that decouples the suction chamber and the opening of the header body, and wherein the aperture is aligned with the fluid passage in both the first state and the second state.

2. A manifold header according to claim 1 further comprising an actuator coupled to the valve body, wherein the actuator is configured to operate the valve in the one or more operating states.

3. A manifold header according to claim 1 further comprising a volute in fluid communication with the opening of the header body.

4. A manifold header according to claim 1 further comprising a mounting device disposed on the header body, wherein the mounting device comprises one or more mounting feet.

5. A manifold header according to claim 1 wherein the valve body comprises a pump opening, and wherein the pump opening is fluidly coupled with the opening of the header body in the first state.

6. A manifold header according to claim 1 wherein the valve body rotates within the fluid passage.

7. A manifold header according to claim 6 wherein the suction chamber is configured to engage portions of the valve body at opposing peripheral walls of the fluid passage.

8. A manifold header according to claim 1 wherein one or more of the pair of opposing openings comprise a fastening implement with a threaded surface.

9. A manifold header according to claim 1 wherein the valve body is configured to permit flow of fluid in at least three directions.

10. A manifold header according to claim 1 wherein the valve body has a spherical shape.

11. A header body comprising:

a housing comprising a volute for receiving an impeller of a pump;

a suction chamber fluidly coupled to the volute, the suction chamber comprising a first opening, a second opening, and a fluid passage permitting a fluid to flow between the first opening and the second opening; and a valve disposed in the fluid passage, wherein the valve comprises a valve body that is supported along one or more peripheral walls of the fluid passage, and wherein the valve body rotates among one or more operating states that comprise a first state that permits the fluid to flow from the fluid passage to the volute and a second state that prohibits the fluid to flow to from the fluid passage to the volute.

12. A header body according to claim 11 further comprising one or more mounting feet coupled to the suction chamber.

13. A header body according to claim 11 further comprising an outer ball valve seat and an inner ball valve seat disposed in opposing relation inside of the fluid passage in the suction chamber, wherein each of the outer ball valve seat and the inner ball valve seat engage a supported portion of the valve body.

14. A header body according to claim 11 further comprising an actuator coupled to the valve body, wherein the actuator is operatively configured to change between the first state and the second state.

15. A header body according to claim 11 wherein the valve body is configured to permit the fluid to flow in at least three directions through the valve.

16. A header body according to claim 15 wherein the valve body includes an aperture, and wherein the aperture is aligned with the fluid passage in each of the first state and the second state.

17. A header body according to claim 11 wherein the housing is configured to secure the pump to the volute.

18. A header body according to claim 11 wherein the aperture is aligned with the fluid passage in both the first state and the second state.

19. A circulation system for a fluid, said circulation system comprising:

a first header body; and a second header body coupled adjacent the first header body, wherein one or more of the first header body and the second header body comprise a volute, a suction chamber in communication with the volute, and a valve disposed in the suction chamber and with a first state that permits the fluid to flow between the suction chamber and the volute, wherein the valve comprises a valve body secured to peripheral walls of the suction chamber.

20. The circulation system according to claim 19 wherein the suction chamber of the first header body is coupled to the suction chamber of the second header body.

* * * * *